US011390985B2

(12) United States Patent
Zheng et al.

(10) Patent No.: US 11,390,985 B2
(45) Date of Patent: Jul. 19, 2022

(54) STEAM IRON

(71) Applicant: Tsann Kuen (Zhangzhou) Enterprise Co., Ltd., Fujian (CN)

(72) Inventors: Zhenxing Zheng, Fujian (CN); Zhixin Su, Fujian (CN)

(73) Assignee: TSANN KUEN (ZHANGZHOU) ENTERPRISE CO., LTD., Fujian (CN)

( * ) Notice: Subject to any disclaimer, the term of this patent is extended or adjusted under 35 U.S.C. 154(b) by 0 days.

(21) Appl. No.: 17/037,291

(22) Filed: Sep. 29, 2020

(65) Prior Publication Data

US 2021/0222355 A1 Jul. 22, 2021

(30) Foreign Application Priority Data

Jan. 19, 2020 (CN) ..... 202010058858.9

(51) Int. Cl.
*D06F 75/12* (2006.01)
*D06F 75/20* (2006.01)
*D06F 75/36* (2006.01)

(52) U.S. Cl.
CPC ..... *D06F 75/12* (2013.01); *D06F 75/20* (2013.01); *D06F 75/36* (2013.01)

(58) Field of Classification Search
CPC ..... D06F 75/00–38
See application file for complete search history.

(56) References Cited

U.S. PATENT DOCUMENTS 3,919,793 A * 11/1975 Toft ..... D06F 75/18 38/77.83
5,388,180 A * 2/1995 Bayles ..... B44C 7/027 392/396
5,532,455 A * 7/1996 Bouleau ..... D06F 75/20 219/245

(Continued)

FOREIGN PATENT DOCUMENTS

CN 1205752 A 1/1999
CN 1986949 A 6/2007
CN 201473800 U 5/2010

(Continued)

OTHER PUBLICATIONS

Search Report appended to an Office Action, which was issued to Chinese counterpart Application No. 2020100588589 by the CNIPA dated Feb. 23, 2022 with an English translation thereof, 6 pages.

*Primary Examiner* — Ismael Izaguirre
(74) *Attorney, Agent, or Firm* — Muncy, Geissler, Olds & Lowe, P.C.

(57) ABSTRACT

A steam iron includes an ironing unit and a water inlet unit. The ironing unit includes an ironing plate and a heating member disposed for heating the ironing plate. The ironing plate has a first heating space, a second heating space isolated from the first heating space, a first steam hole in fluid communication with the first heating space, and a plurality of second steam holes in fluid communication with the second heating space. The steam iron is operable to convert between a power mode, where water is only introduced from the water inlet unit into the first heating space, and a regular mode, where water is introduced from the water inlet unit into the first and second heating spaces.

6 Claims, 5 Drawing Sheets

(56) References Cited

U.S. PATENT DOCUMENTS

| | | | | |
|---|---|---|---|---|
| 5,979,089 | A * | 11/1999 | Bouleau | D06F 75/20 38/77.83 |
| 2004/0025382 | A1 * | 2/2004 | Walther | D06F 75/38 38/77.83 |

FOREIGN PATENT DOCUMENTS

| | | | |
|---|---|---|---|
| EP | 3269874 | A1 * | 1/2018 |
| FR | 2899907 | A1 * | 10/2007 |

* cited by examiner

STEAM IRON

CROSS-REFERENCE TO RELATED APPLICATION

This application claims priority to Chinese Invention Patent Application No. 202010058858.9, filed on Jan. 19, 2020.

FIELD

The disclosure relates to an iron, and more particularly to a steam iron.

BACKGROUND

A conventional steam iron mainly includes a main body defining a heating space, a water inlet tube connected to the heating space, and a plurality of steam holes being in fluid communication with the heating space. When water is introduced from the water inlet tube into the heating space, the water is heated and steam is generated and released through the steam holes.

However, when the object to be ironed is a thick or heavy garment, or has substantial wrinkles, it is difficult to iron such objects with the conventional steam iron.

SUMMARY

Therefore, an object of the disclosure is to provide a steam iron that can alleviate at least one of the drawbacks of the prior art.

According to the disclosure, the steam iron includes an ironing unit and a water inlet unit.

The ironing unit includes an ironing plate and a heating member that is disposed for heating the ironing plate. The ironing plate of the ironing unit has a first heating space, a second heating space isolated from the first heating space, a first steam hole being in fluid communication with the first heating space, and a plurality of second steam holes that are in fluid communication with the second heating space.

The water inlet unit is in fluid communication with the first and second heating spaces.

The steam iron is operable to convert between a power mode, where water is only introduced from the water inlet unit into the first heating space, and a regular mode, where water is introduced from the water inlet unit into the first and the second heating spaces.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
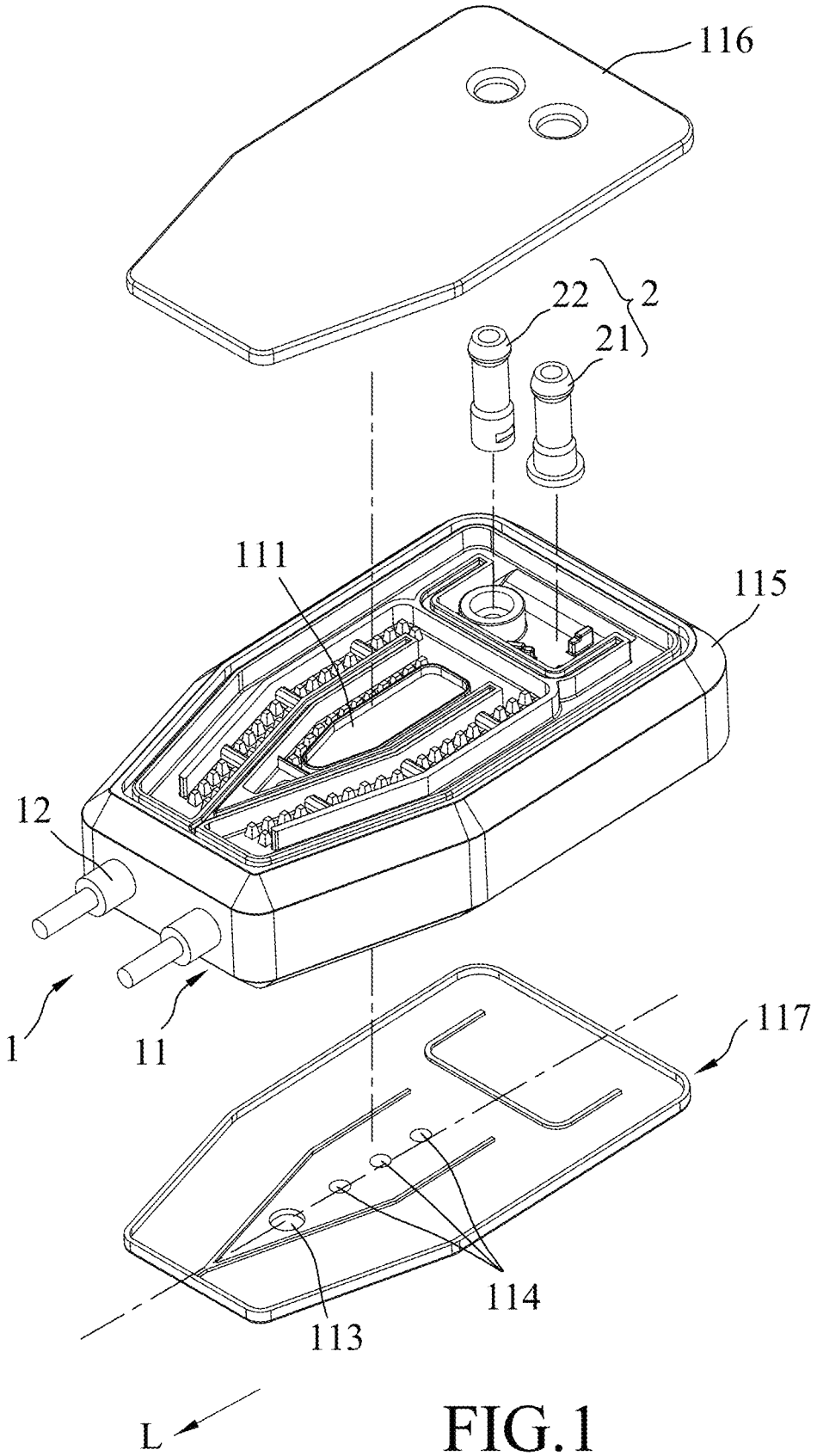
FIG. 1 is an exploded perspective view illustrating an embodiment of the steam iron according to the disclosure.
Figure 2:
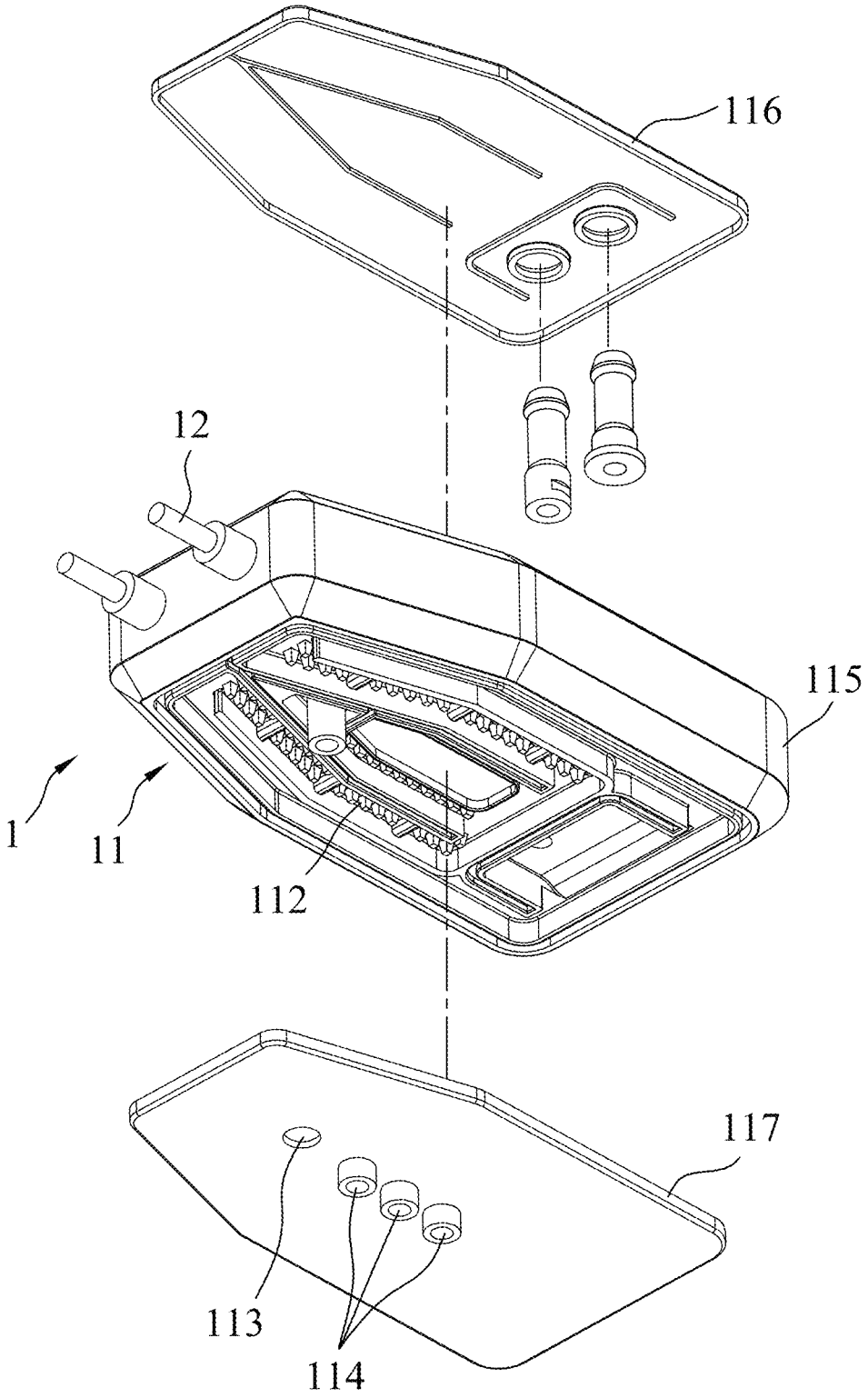
FIG. 2 is another exploded perspective view from another angle of view.
Figure 3:
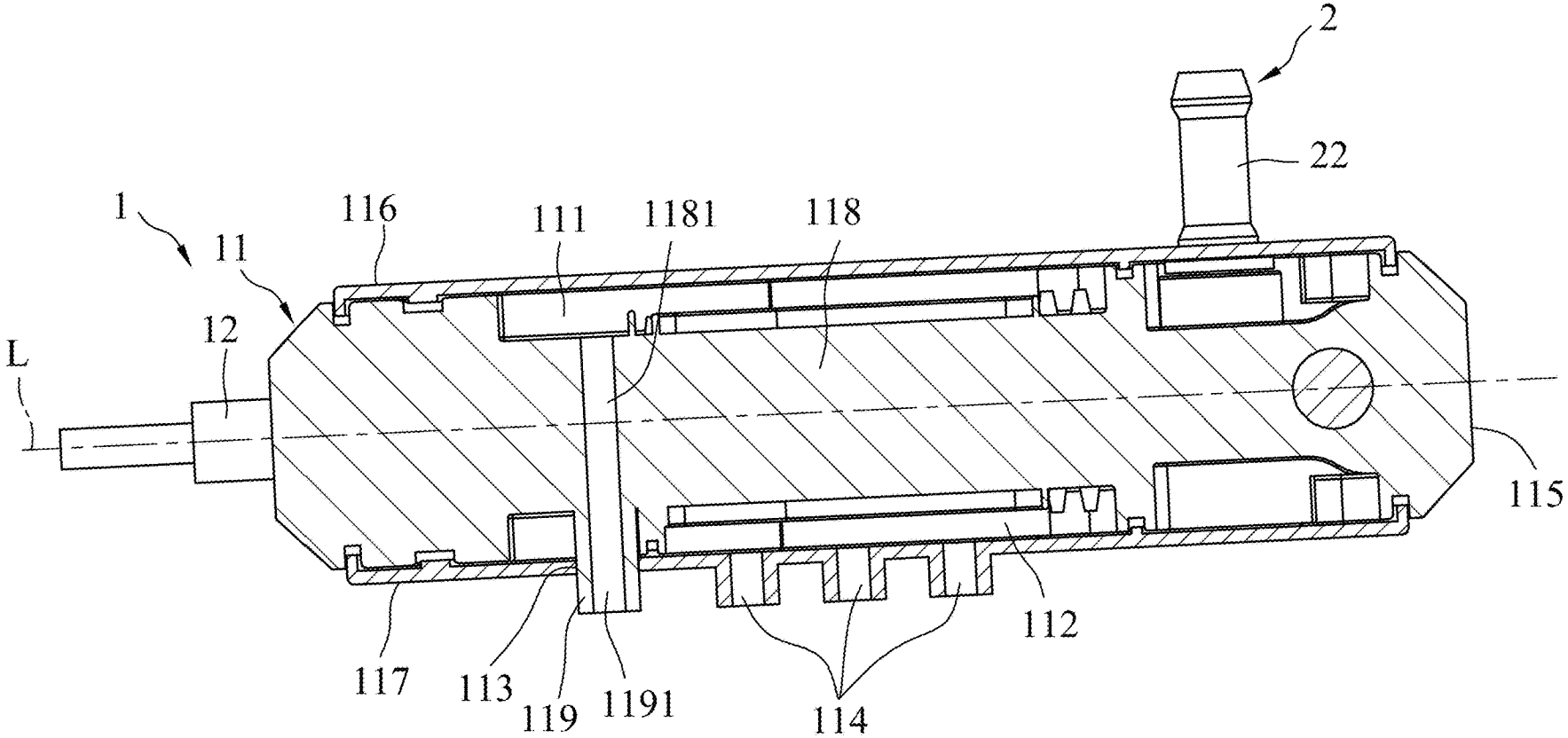
FIG. 3 is a sectional view of the embodiment.
Figure 4:
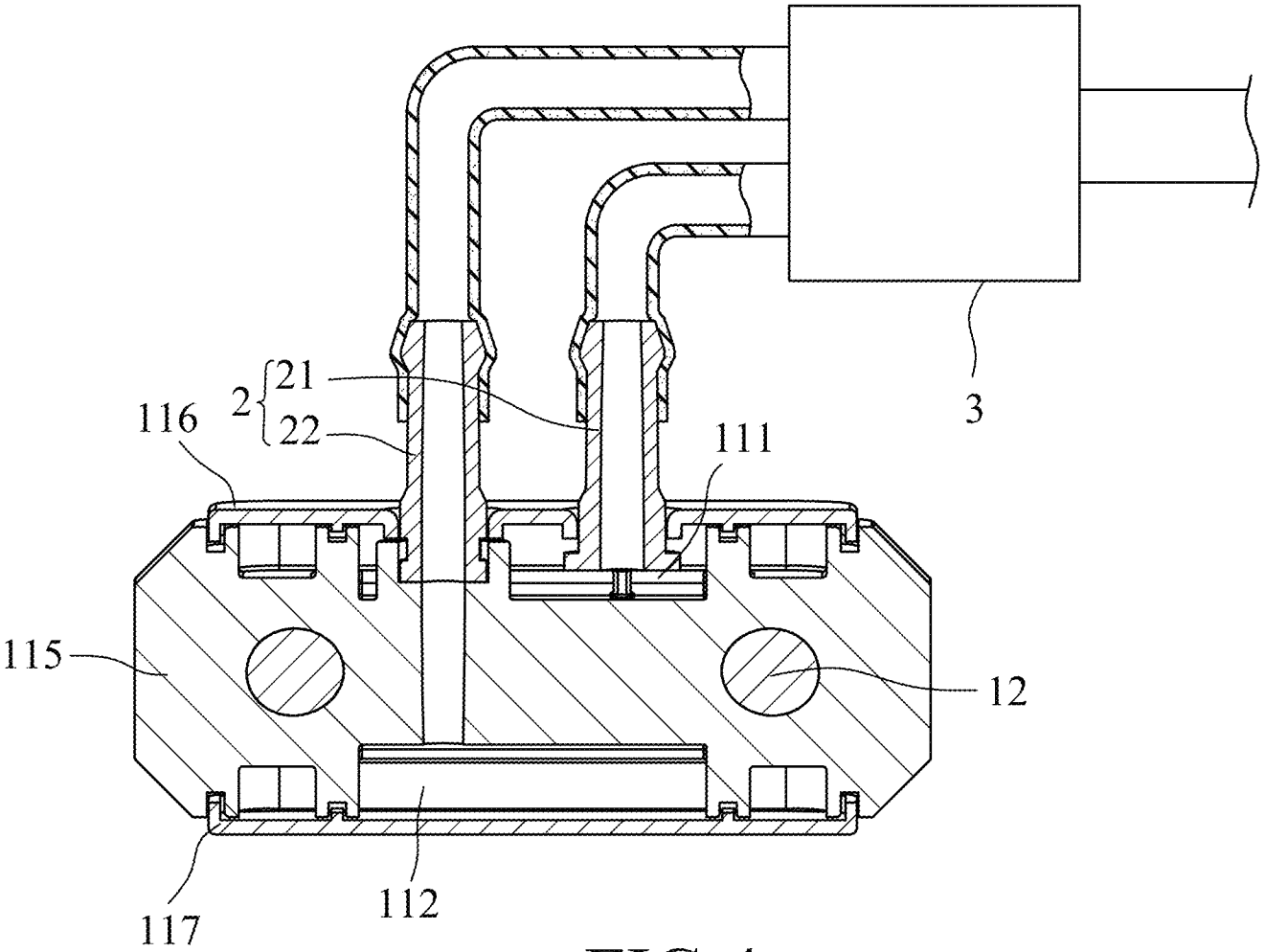
FIG. 4 is a fragmentary sectional view.

Referring to FIGS. 1, 3 and 4, an embodiment of a steam iron according to the disclosure includes an ironing unit 1, a water inlet unit 2 that introduces water into the ironing plate 11, and a controller 3 that is connected to the water inlet unit 2.

As shown in FIGS. 1 and 3, the ironing unit 1 includes the ironing plate 11 and a heating member 12 that is disposed for heating the ironing plate 11.

The ironing plate 11 is elongated in a longitudinal direction (L), and has a substantially-rectangular main segment 115, a cover segment 116 that is connected to the main segment 115 and that cooperates with the main segment 115 to define a first heating space 111 therebetween, and a plate segment 117 that is connected to the main segment 115 and that cooperates with the main segment 115 to define a second heating space 112 therebetween. The main segment 115 of the ironing plate 11 has a main body 118 that defines a first channel 1181, and a connecting tube 119 that extends from the main body 118 to the plate segment 117 of the ironing plate 11 and defines a second channel 1191. The first and second channels 1181, 1191 are connected to each other.

The first heating space 111 and the second heating space 112 overlap each other and are isolated from each other. In this embodiment, the first heating space 111 is disposed over the second heating space 112.

The plate segment 117 is formed with a first steam hole 113 that is in fluid communication with the first heating space 111, and three second steam holes 114 that are in fluid communication with the second heating space 112. The first steam holes 113 and the second steam holes 114 are arranged in the longitudinal direction (L). Specifically, the connecting tube 119 of the main segment 115 extends through the first steam hole 113, and the first channel 1181 and the second channel 1191 interconnect the first heating space 111 and the first steam hole 113 and are isolated from the second heating space 112 and the second steam holes 114.

Figure 5:
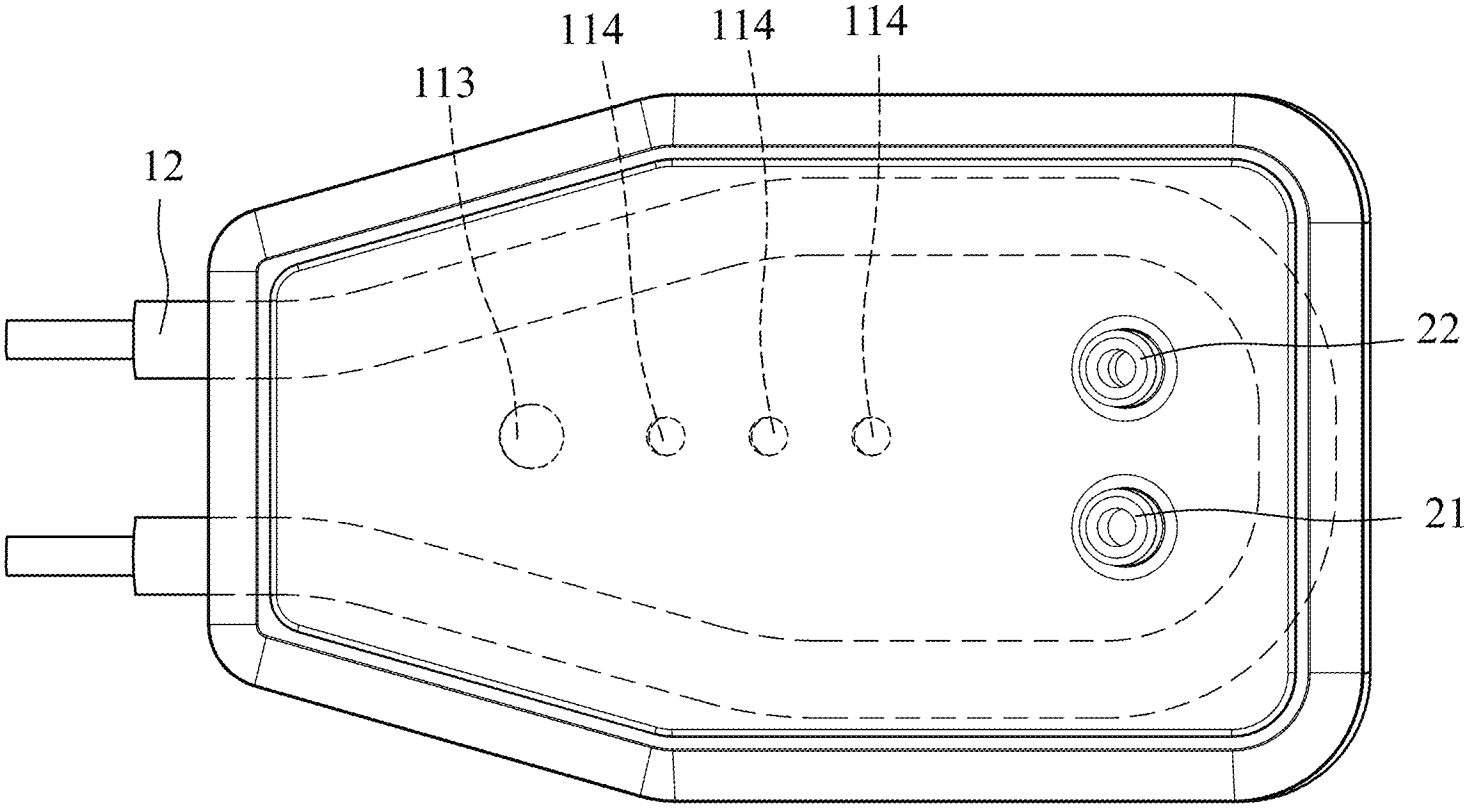
FIG. 5 is a top view of the embodiment.

Referring to FIGS. 3, to 5, the heating member 12 is a heating tube that is disposed in the main segment 115 of the ironing plate 11. A projection of the heating member 12 on the plate segment 117 of the ironing plate 11 surrounds the first and the second steam holes 113, 114.

The water inlet unit 2 is in fluid communication with the first and second heating spaces 111, 112. Specifically, the water inlet unit 2 includes a first water tube 21 that extends through the cover segment 116 of the ironing plate 11 for passage of water therethrough into the first heating space 111, and a second water tube 22 that extends through the cover segment 116 and the main segment 115 of the ironing plate 11 for passage of water therethrough into the second heating space 112.

A distance between the first steam hole 113 and a projection of the first water tube 21 on the plate segment 117 of the ironing plate 11 is longer than a distance between each of the second steam holes 114 and a projection of the second water tube 22 on the same plate segment 117 of the ironing plate 11.

Through the configuration of controller 3, the steam iron is operable to convert between a power mode, where water is only introduced from the first water tube 21 of the water inlet unit into the first heating space 111, and a regular mode, where water is introduced from both the first water tube 21 and the second water tube 22 of the water inlet unit 2 into both the first heating space 111 and the second heating space 112.

When the steam iron is converted to the power mode, the steam is released through the first steam hole 113 in a concentrated manner, so that objects such as heavy or thick garments, or cloth with substantial wrinkles can be ironed. When the steam is converted to the regular mode, the steam is evenly released through the first steam holes 113 and the second steam holes 114, so that a wider area of relatively lighter or thinner objects with shallower wrinkles can be ironed.

It should be noted that, the number of the second steam hole 114 is not limited to three. In other embodiments, the number of the second steam hole 114 may vary depending on the usage.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A steam iron comprising:

an ironing unit including an ironing plate that has a first heating space, a second heating space isolated from said first heating space, a first steam hole being in fluid communication with said first heating space, and a plurality of second steam holes being in fluid communication with said second heating space, and a heating member that is disposed for heating said ironing plate; and a water inlet unit being in fluid communication with said first and second heating spaces;

wherein said steam iron is operable to convert between a power mode, where water is only introduced from said water inlet unit into said first heating space, and a regular mode, where water is introduced from said water inlet unit into said first and second heating spaces;

wherein said first and second heating spaces overlap each other; and wherein said ironing plate has:

a main segment, said heating member being disposed in said main segment;

a cover segment connected to said main segment and cooperating with said main segment to define said first heating space; and a plate segment connected to said main segment, cooperating with said main segment to define said second heating space, and formed with said first and second steam holes.

2. The steam iron as claimed in claim 1, wherein said main segment of said ironing plate has a main body that defines a first channel, and a connecting tube that extends from said main body to said plate segment of said ironing plate and that defines a second channel, said first and second channels being connected to each other, interconnecting said first heating space and said first steam hole, and being isolated from said second heating space and said second steam holes.

3. The steam iron as claimed in claim 2, wherein said water inlet unit includes:

a first water tube extending through said cover segment of said ironing plate for passage of water therethrough into said first heating space; and a second water tube extending through said cover segment and said main segment of said ironing plate for passage of water therethrough into said second heating space.

4. The steam iron as claimed in claim 3, wherein a distance between said first steam hole and a projection of said first water tube on said plate segment of said ironing plate is longer than a distance between each of said second steam holes and a projection of said second water tube on said plate segment of said ironing plate.

5. The steam iron as claimed in claim 4, wherein said first and second steam holes are arranged in a longitudinal direction of said ironing plate.

6. The steam iron as claimed in claim 5, wherein a projection of said heating member on said plate segment of said ironing plate surrounds said first and second steam holes.

* * * * *